US005393075A

United States Patent [19]

Harber

[11] Patent Number: 5,393,075

[45] Date of Patent: Feb. 28, 1995

[54] MOBILE

[76] Inventor: Christopher Harber, 10 Kimmons Ct., Kanata, Ontario, Canada, K2K 2M4

[21] Appl. No.: 252,201

[22] Filed: Jun. 1, 1994

[51] Int. Cl.[6] ..... G09F 19/00

[52] U.S. Cl. ..... 273/459; 40/617; 428/7; 446/176; 446/227

[58] Field of Search ..... 273/459; 446/176, 227; 40/613, 617; 428/7, 11; D11/141; D21/63

[56] References Cited

U.S. PATENT DOCUMENTS

| | | | |
|---|---|---|---|
| D. 235,024 | 4/1975 | Bloom | D11/141 |
| 3,376,664 | 4/1968 | Sauer | 446/176 |
| 3,774,328 | 11/1973 | Tanney | 40/617 X |
| 4,009,534 | 3/1977 | Bradt | D11/141 X |
| 4,106,228 | 8/1978 | Gibrich | 40/617 X |

*Primary Examiner*—William H. Grieb
*Attorney, Agent, or Firm*—Marks & Clerk

[57] ABSTRACT

A mobile suspendable from a fixed support, comprises a planar image support member suspended on a flexible line so as to undergo random motion in the presence of air currents. An image carried by said support member, which creates a visual effect that directs the eye of a viewer to a remote point spaced from the support member and having a fixed spatial relationship to it. A three-dimensional object, such as a miniature basketball, is mounted on a stiff wire attached to the support member such that the three-dimensional object is maintained substantially at the remote point having a fixed spatial relationship to the support member.

7 Claims, 1 Drawing Sheet

MOBILE

BACKGROUND OF THE INVENTION

The present invention relates to a mobile, suitable for decorative use, such as in children's nurseries and the like.

Mobiles are known that comprise a series of objects, such as miniature cars, airplanes, animals and the like suspended on strings from an overhead star-shaped support in such a way that the objects undergo random motion in convection currents generally present in a room. Such mobiles are often used in nurseries as a way of distracting the attention of a young child or baby while in his or her crib. Generally mobiles are sold as low cost novelty items, and sometimes they are purely two-dimensional, consisting of cards bearing pictures of familiar objects. Such mobiles are more economical to make, and can be more conveniently packaged in the flat state for assembly by the purchaser.

An object of the invention is to provide a novel mobile that has the advantages of low cost and ease of packaging of two-dimensional mobiles, but which provides an enhanced effect to the viewer.

SUMMARY OF THE INVENTION

The present mobile is constructed so as to direct the eye of the viewer away from the conventional mobile flat, image-bearing component to a three-dimensional object which is maintained at a fixed remote position from the rest of the mobile.

In one aspect the invention provides a mobile suspendable from a fixed support, comprising at least one planar image support member suspended on a flexible line so as to undergo random motion in the presence of air currents; an image carried by said support member, said image creating a visual effect that directs the eye of a viewer to a remote point spaced from said support member and having a fixed spatial relationship thereto; and a three-dimensional object mounted on a stiff wire attached to said support member such that said three-dimensional object is maintained substantially at said remote point having a fixed spatial relationship to said support member.

In this specification, it is to be understood that the term "wire" is not limited to conductive or metallic wires, but includes any linear support member capable of holding the object in a substantially fixed position. For example, it could be made of a suitable plastics material.

The novel and striking effect of the invention comes in part from the contrast between the two-dimensional photograph and the three-dimensional object that relates directly to the scene in the photograph. For example, the photograph can be of basketball players looking up at a ball, which is out of the picture, in which case the object would be the ball located at the appropriate position for the scene in the photograph. Other scenes are possible where there is a relationship between the two-dimensional image and the three-dimensional object. For example, a birdwatcher might be seen looking up through binoculars in the picture at a three-dimensional bird mounted on the wire in the appropriate position for his line of sight.

The object will be a ball, airplane, bird, falling leaf or the like that appears suspended in flight related to the subject matter of the image.

It should be appreciated for the effect to be most pronounced, the viewer's attention should be directed to a point in the same plane as the support member.

The wire is preferably resilient so that the object also undergoes oscillatory movement relative to the card. For example in the case of the ball, this will be seen to oscillate in the appropriate position for the photograph.

Although the object support is referred to as a wire, it is understood that that any wire like line, for example, made of synthetic material, could be employed. The use of the term "wire" is not intended to imply that the support is necessarily made of metal.

BRIEF DESCRIPTION OF THE DRAWINGS

The invention will be further explained by reference to the accompanying drawings, in which.

DESCRIPTION OF THE PREFERRED EMBODIMENTS

Figure 1:
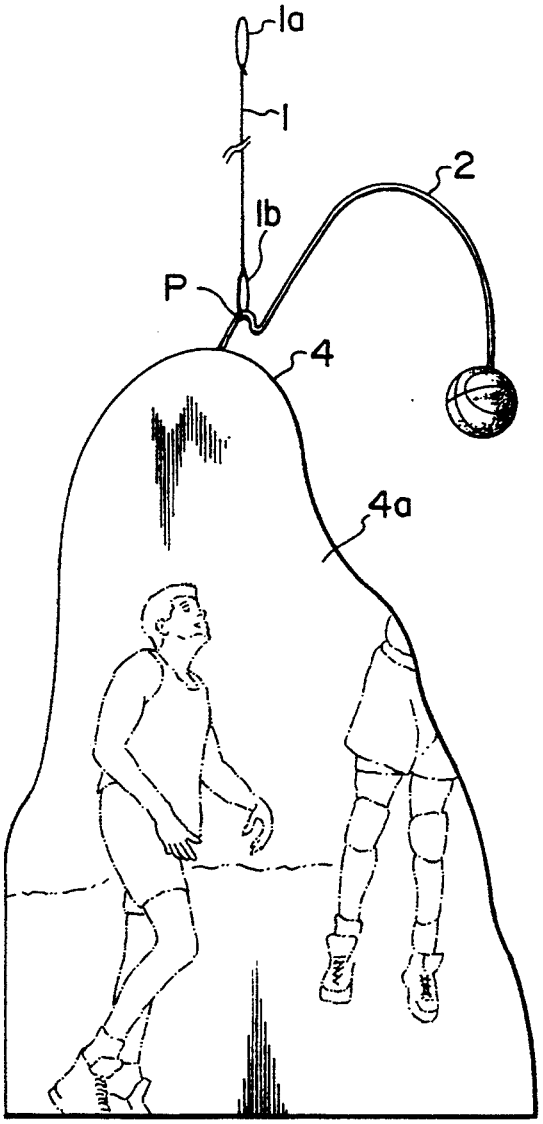
FIGS. 1 and 2 show alternate sides of the mobile.
Figure 2:
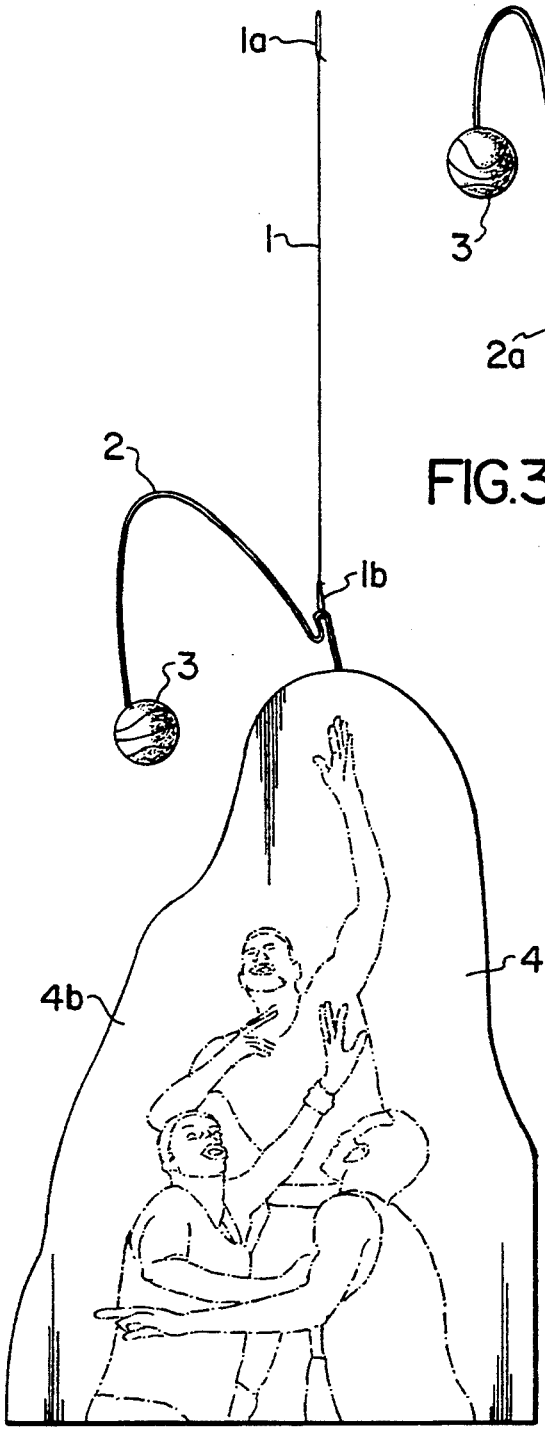

As shown in the Figures, flexible line 1 is used to suspend the mobile from a fixed support, such as a ceiling. Flexible line 1 can be made of any suitable material, and is preferably made of colorless (transparent) nylon thread. Ends 1*a* and 1*b* of line 1 are tied, respectively, to a suitable support and a kink providing pivot point P formed in stiff wire 2.

The stiff wire 2, which can be made of any suitable material, is attached at its proximate end to planar image support member 4, which is made of stiff card, and at its distal end to a three-dimensional object 3, in this case a miniature basket ball. The wire 2 is kinked, as shown in the Figures, to provide a pivot point P from which the entire mobile can be hung via line 1 in a balanced manner.

The wire 2 is bent in order to remotely position the three-dimensional object 3 from the image support member 4. The shape of the bent wire 2, which may be easily changed, will depend on the relative mass of components 3 and 4 of the mobile and the total length of the wire 2 in order to provide a balanced pivot point. An important feature of the invention is that the images 4a or 4b cause the viewer's eye to become focused on an imaginary fixed point in space relative to the card due to the fact that the players are all clearly looking at and reaching out to this point, which is not visible in the photograph but which is clearly where the ball is located. Also, this point lies in the same plane as the support member 2. The three-dimensional object 3 is maintained at this point by the wire 2 so that the viewer naturally finds the appropriate object at the right place. The creates an interesting psychological effect, which seems to bring the flat two-dimensional photograph "alive".

In the present case the three-dimensional object 3 is a miniature basketball and, accordingly, the images 4*a* and 4*b* depict basketball players in action. The basketball 3 is made at the correct scale relative to the images depicted on the support member 4. Although the images 4*a* and 4*b* can be the same, it is preferred that different images are used. As previously stated, the images 4*a* and 4*b*, as shown in the Figures, need to be such that a viewer on looking at them has his eye directed toward the basketball 3. Also as noted above, the positioning of the basketball 3 relative to the images 4*a* and 4*b* needs to be such that it is at the focus of the viewer's upward glance. The resilience of the wire 2 enhances this effect by causing the ball to undergo gentle oscillations.

The wire 2 is so shaped that it follows the natural curved path that would be followed by the ball 3 in a real-life situation. This further enhances the realistic effect produced the mobile and assists in the transition from the two to three dimensional domains.

The planar image support member 4 is normally made of cardboard or a similar material and can be of any shape. However, an irregular contoured shape, as shown in the Figures, is preferred to a regular geometrical shape.

Standard techniques can be used to attach the basketball 3 to the wire 2, and print or attach the images 4*a* and 4*b* onto the support 4.

Figure 3:
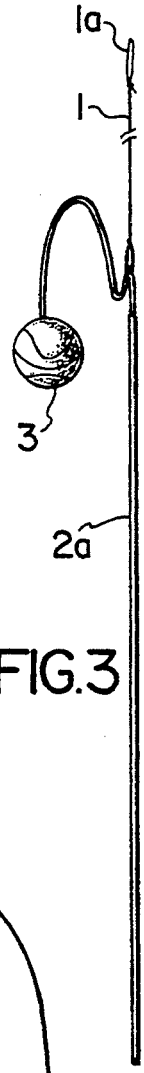
FIG. 3 illustrates how the three-dimensional object is joined to the image support end of the mobile.

As shown in FIG. 3, the wire 2 is provided with a sleeve 2*a* firmly attached thereto. The section of the wire 2 with the sleeve 2*a* is embedded in the support member 4 and thus the entire mobile is assembled.

The random movement of the mobile by air currents is conventional. However, the construction of the mobile produces for the viewer a three-dimensional image of a part of a basketball game. This effect is obtained by a combination of factors including the motion of the mobile, the directing of the viewer's eye, by the images 4*a* or 4*b*, upwards and to a fixed point remote from support 4 at which fixed point the basketball 3 is suspended.

As mentioned above, the basketball should lie in the same plane as the support member, in which case it is important that the viewer's attention be directed at this point. In other words, the scene should be photographed in such a way that the players (or other characters) are all looking at or reaching out to a point in the same plane as the card. The invention will still work if the object is in a different plane, but the effect is much less pronounced and also of course it much harder to find suitable images that will work on a two-sided support member.

Although only one card has been shown, it will be apparent to one skilled in the art that a plurality of cards can be suspended in a conventional arrangement from on overhead support, such as a star-shaped support, for example.

I claim:

1. A mobile suspendable from a fixed support, comprising:

at least one planar image support member suspended on a flexible line so as to undergo random motion in the presence of air currents;

an image carried by said support member, said image creating a visual effect that directs the eye of a viewer to a remote point spaced from said support member and having a fixed spatial relationship thereto; and a three-dimensional object mounted on a stiff wire attached to said support member such that said three-dimensional object is maintained substantially at said remote point having a fixed spatial relationship to said support member.

2. A mobile as claimed in claim 1, wherein the wire is resilient so that the object undergoes gentle oscillations on the end thereof.

3. A mobile as claimed in claim 1, wherein the wire is shaped so as to follow the natural path of said object from said two-dimensional image.

4. A mobile as claimed in claim 1, wherein the planar support member is in the form of a card bearing at least one photograph of a scene relevant to said object.

5. A mobile as claimed in claim 1, wherein said object is a ball.

6. A mobile as claimed in claim 1, said ball is made at the correct scale relative to the image on said support member to enhance the realism of the effect produced by the mobile.

7. A mobile as claimed in claim 1, wherein said object is lies in the same plane as said support member.

* * * * *